US010274881B2

(12) United States Patent
Koyama

(10) Patent No.: US 10,274,881 B2
(45) Date of Patent: Apr. 30, 2019

(54) IMAGE FORMING APPARATUS INCLUDING PAPER DUST COLLECTING AND OPTICAL DETECTION

(71) Applicant: CANON KABUSHIKI KAISHA, Tokyo (JP)

(72) Inventor: Shoichi Koyama, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/940,504

(22) Filed: Mar. 29, 2018

(65) Prior Publication Data

US 2018/0299812 A1 Oct. 18, 2018

(30) Foreign Application Priority Data

Apr. 12, 2017 (JP) ..... 2017-078737

(51) Int. Cl.
*G03G 15/00* (2006.01)
*G03G 21/00* (2006.01)

(52) U.S. Cl.
CPC ..... *G03G 15/5004* (2013.01); *G03G 15/5029* (2013.01); *G03G 15/6558* (2013.01); *G03G 2221/0042* (2013.01)

(58) Field of Classification Search
CPC ..... G03G 15/5004; G03G 15/5029; G03G 15/6558; G03G 21/00; G03G 2215/00607; G03G 2221/0026; G03G 2221/0042
USPC ..... 399/98
See application file for complete search history.

(56) References Cited

U.S. PATENT DOCUMENTS 5,828,924 A * 10/1998 Fukada ..... G03G 15/1655 399/98
6,266,499 B1 * 7/2001 Murata ..... G03G 15/6558 399/98
2015/0334263 A1 * 11/2015 Chubachi ..... G03G 15/5029 358/475
2017/0269512 A1 * 9/2017 Nakajima ..... G03G 21/00

FOREIGN PATENT DOCUMENTS

JP H04-144845 A 5/1992
JP 6-2154 Y2 1/1994
JP 2004-86071 A 3/2004
JP 2010-222107 A 10/2010
JP 2014-114131 A 6/2014

* cited by examiner

*Primary Examiner* — Sophia S Chen
(74) *Attorney, Agent, or Firm* — Canon USA, Inc., IP Division

(57) ABSTRACT

An image forming apparatus includes a paper dust collecting unit which collects, by application of a voltage, paper dust attached to a sheet, an optical detection unit provided on a downstream side of the paper dust collecting unit in a sheet conveyance direction, which irradiates the sheet with light and receives light via the sheet, a guide member which comes into contact with the sheet to be conveyed to guide the sheet, at least one of light directed toward the sheet from the optical detection unit and light directed toward the optical detection unit from the sheet passing through the guide member, and a control unit which switches a polarity of the voltage to be applied to the paper dust collecting unit and causes the sheet charged through the paper dust collecting unit to be conveyed to the guide member.

13 Claims, 8 Drawing Sheets

IMAGE FORMING APPARATUS INCLUDING PAPER DUST COLLECTING AND OPTICAL DETECTION

BACKGROUND

Field of the Disclosure

The present disclosure generally relates to image forming and, more particularly, to an image forming apparatus including a paper dust collecting unit that collects paper dust attached to a sheet, and an optical detection unit that irradiates the sheet with light and receives light via the sheet.

Description of the Related Art

It has heretofore been known that some image forming apparatuses, such as a copier and a printer, are provided with a paper dust collecting roller to collect paper dust attached to a sheet. In an image forming apparatus discussed in Japanese Patent Application Laid-Open No. 2010-222107, a paper dust collecting roller is charged to be brought into contact with a sheet, thereby collecting paper dust attached to the sheet.

In addition, Japanese Patent Application Laid-Open No. 2014-114131 discusses an image forming apparatus including an optical sensor that captures an image of a surface of a sheet by irradiating the sheet with light, thereby discriminating the type of the sheet. The optical sensor is covered with a transparent cover member formed of glass or the like, and the image of the surface of the sheet is captured through the cover member. The sheet is conveyed along the cover member. Accordingly, the cover member also functions as a sheet guide member.

An image forming apparatus including both the paper dust collecting roller and the optical sensor has areas for improvement for at least the following reasons.

A sheet that is brought into contact with the paper dust collecting roller to collect paper dust attached to the sheet is charged to the same polarity as the paper dust collecting roller. When the charged sheet is conveyed to the optical sensor, the sheet and the guide member are brought into contact with each other and rubbed together, so that the sheet is charged to the same polarity as the guide member. If this state lasts for a long time after a print operation is terminated, dust or the like suspended in the image forming apparatus may be adsorbed to the guide member. This may result in deterioration in the detection accuracy of the optical sensor.

SUMMARY

The present disclosure relates to suppressing a deterioration in the detection accuracy of an optical detection unit in an image forming apparatus including a paper dust collecting unit and the optical detection unit.

According to one or more aspects of the present disclosure, an image forming apparatus includes a paper dust collecting unit configured to collect, by application of a voltage, paper dust attached to a sheet, an optical detection unit provided on a downstream side of the paper dust collecting unit in a sheet conveyance direction, the optical detection unit being configured to irradiate the sheet with light and receive light via the sheet, a guide member configured to come into contact with the sheet to be conveyed to guide the sheet, at least one of light directed toward the sheet from the optical detection unit and light directed toward the optical detection unit from the sheet passing through the guide member, and a control unit configured to switch a polarity of the voltage to be applied to the paper dust collecting unit and cause the sheet charged through the paper dust collecting unit to be conveyed to the guide member.

Further features of the present disclosure will become apparent from the following description of exemplary embodiments with reference to the attached drawings.

DESCRIPTION OF THE EMBODIMENTS

Exemplary embodiments of the present disclosure will be described below with reference to the drawings.

Figure 1:
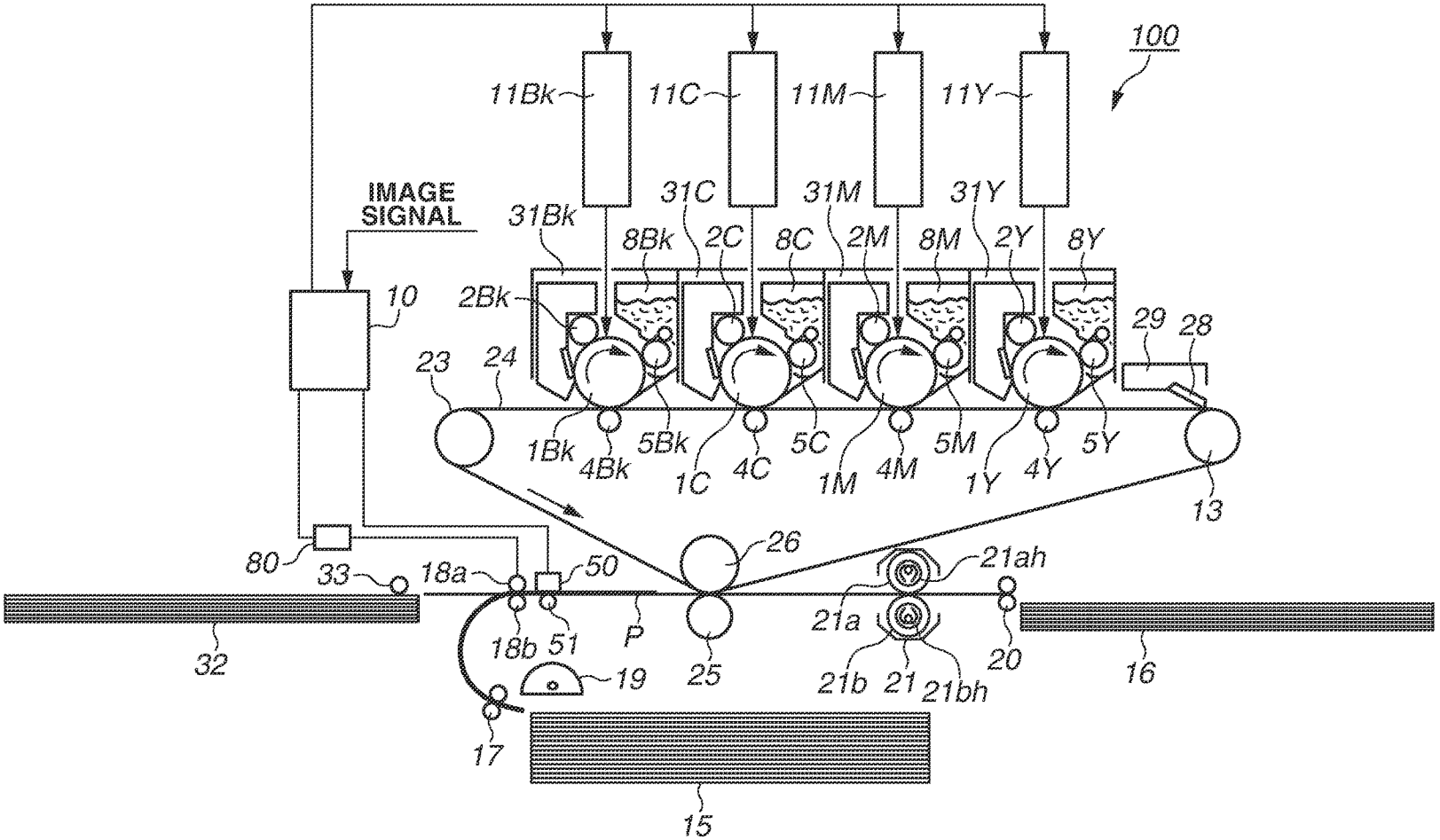
FIG. 1 illustrates a configuration of a laser beam printer.

A first exemplary embodiment illustrates a laser beam printer 100 (hereinafter referred to as the printer 100) of an electrophotographic system as an example of an image forming apparatus. FIG. 1 illustrates the configuration of the printer 100.

The printer 100 includes a sheet feeding cassette 15, photosensitive drums 1, charging rollers 2, laser scanners 11, developing devices 8, and primary transfer rollers 4, which correspond to stations for four colors of yellow (Y), magenta (M), cyan (C), and black (Bk), respectively. The printer 100 also includes an intermediate transfer belt 24, a drive roller 23 that drives the intermediate transfer belt 24, a stretching roller 13, a secondary transfer roller 25, a secondary-transfer opposing roller 26, a fixing device 21, and a control unit 10 (central processing unit (CPU)), which may include one or more processors and one or more memories, that may control these members. Symbols "Y, "M", "C" and "Bk" are omitted in the following description, except for a case where a member corresponding to a specific color is explained.

Each of the photosensitive drums 1 is a photosensitive member having a configuration where an organic photoconductive layer is coated on the outer periphery of an aluminum cylinder. Each of the photosensitive drums 1 receives a driving force of a motor (not illustrated) and rotates in a direction indicated by an arrow in FIG. 1. When the control unit 10 receives an image signal and starts image formation, a sheet feeding roller 19 feeds a sheet P placed in the sheet feeding cassette 15. The sheet P fed by the sheet feeding roller 19 passes through conveyance rollers 17 and is then conveyed to a paper dust collecting roller 18*a* to which a high-voltage bias (voltage) is applied by a high-voltage bias generating unit 80. The paper dust collecting roller 18*a* nips the sheet P at a nip portion, that is formed by the paper dust collecting roller 18*a* and a registration roller 18*b*, to temporarily stop the conveyance of the sheet P, and thereafter, the sheet P stands by so that the timing of conveying the sheet P is adjusted according to a toner image formed on the intermediate transfer belt 24.

In the present exemplary embodiment, the paper dust collecting roller 18*a* that collects paper dust attached to the sheet P is disposed at a position opposed to the registration roller 18*b*. With this configuration, cost reduction and downsizing can be achieved, unlike in a configuration in which a registration roller pair and a paper dust collecting roller pair are separately arranged. In the present exemplary embodiment, the length of the paper dust collecting roller 18*a* in a width direction of the sheet P is set to be longer than the width of the sheet P of a maximum sheet passing size such that the entire surface of the sheet P can be covered. However, the length of the paper dust collecting roller 18*a* is not limited to this. Because paper dust is particularly likely to be attached to a central portion in the width direction in which the sheet feeding roller 19 and the like contact the sheet P, the length of the paper dust collecting roller 18*a* may be set to be shorter than the width of the sheet P and may correspond to the length corresponding to the central portion.

Each of the charging rollers 2 charges the surface of the corresponding photosensitive drum 1 to a certain potential. The control unit 10 causes each of the laser scanners 11 to irradiate laser light according to the received image signal, to form an electrostatic latent image on the surface of the photosensitive drum 1. Each of the developing devices 8 visualizes the electrostatic latent image with toner. The developing device 8 is provided with a developing sleeve 5. A developing bias for visualizing the electrostatic latent image is applied to the developing device 8. In each of the stations for the respective colors, the electrostatic latent image formed on the surface of the photosensitive drum 1 is developed as a monochromatic toner image by action of the developing device 8. The photosensitive drum 1, the charging roller 2, and the developing device 8 in each of the stations for the respective colors are integrated as a toner cartridge 31 detachably attached to the main body of the printer 100.

The intermediate transfer belt 24 is in contact with each of the photosensitive drums 1 for the respective colors, and rotates in synchronization with the rotation of each of the photosensitive drums 1 for the respective colors in a direction indicated by an arrow in FIG. 1. The developed monochromatic toner image is sequentially transferred onto the intermediate transfer belt 24 by action of a primary transfer bias applied to each of the primary transfer rollers 4, thereby obtaining a multicolor toner image. After that, the multicolor toner image formed on the intermediate transfer belt 24 is conveyed to a secondary transfer nip portion formed by the secondary transfer roller 25 and the secondary-transfer opposing roller 26. At the same time, the sheet P which stands by in a state where the sheet P is nipped between the paper dust collecting roller 18*a* and the registration roller 18*b* is conveyed to the secondary transfer nip portion in synchronization with a leading edge of the multicolor toner image formed on the intermediate transfer belt 24. The multicolor toner image formed on the intermediate transfer belt 24 is collectively transferred onto the sheet P by action of a secondary transfer bias applied to the secondary transfer roller 25.

The fixing device 21 fuses and fixes the multicolor toner image onto the sheet P while conveying the sheet P. The fixing device 21 includes a fixing roller 21*a* that heats the sheet P, and a pressure roller 21*b* that brings the sheet P into pressure contact with the fixing roller 21*a*. The fixing roller 21*a* and the pressure roller 21*b* are each formed in a hollow shape and incorporate heaters 21*ah* and 21*bh*, respectively. The sheet P onto which the multicolor toner image is transferred is conveyed by a fixing nip portion, which is formed by the fixing roller 21*a* and the pressure roller 21*b*, and heat and pressure are applied to the sheet P to fix the toner image onto the surface of the sheet P. The sheet P onto which the toner image is fixed is discharged into a discharge tray 16 by discharge rollers 20, and the image forming operations are finished. A series of image forming operations as described above is controlled by the control unit 10.

A cleaning blade 28 is used to clean the toner that is not transferred onto the sheet P and remains on the intermediate transfer belt 24. The collected transfer-residual toner is accumulated as waste toner in a waste toner container 29. A manual feed tray 32 is a paper feed port for the sheet P. The manual feed tray 32 is different from the sheet feeding cassette 15. The sheet P placed on the manual feed tray 32 is fed by a manual feed roller 33. A conveyance path for the sheet P fed from the manual feed tray 32 and a conveyance path for the sheet P fed from the sheet feeding cassette 15 merge at a position on an upstream side of the paper dust collecting roller 18*a* in the conveyance direction of the sheet P.

In the printer 100 illustrated in FIG. 1, an optical sensor 50 is disposed on a downstream side of the paper dust collecting roller 18*a* in the conveyance direction of the sheet P. The optical sensor 50 can detect information in which the surface state of the sheet P conveyed from the sheet feeding cassette 15 or the manual feed tray 32 is reflected. A driven roller 51 having a roller shape is disposed at a position opposed to the optical sensor 50 with the conveyance path for the sheet P interposed therebetween. The driven roller 51 (rotary member) is driven and rotated by the sheet P conveyed by the paper dust collecting roller 18*a* and the registration roller 18*b*. With this configuration, the conveyance of the sheet P in the optical sensor 50 can be smoothly performed and the conveyance flutter of the sheet P can be suppressed. The suppression of the conveyance flutter of the sheet P enables the optical sensor 50 to accurately detect the information in which the surface state of the sheet P is reflected.

The operation for detecting the sheet P by the optical sensor 50 is performed during a period from a time when the leading edge of the sheet P passes through the optical sensor 50 to a time when the leading edge of the sheet P reaches the secondary transfer roller 25. The control unit 10 discriminates the type (smooth paper, plain paper, rough paper, etc.) of the sheet P based on the surface state of the sheet P detected by the optical sensor 50. Further, the control unit 10 changes image forming conditions depending on the type of the sheet P. In other words, the control unit 10 changes the image forming conditions based on the detection result of the optical sensor 50. Specific examples of the image forming conditions include the conveyance speed of the sheet P, the transfer bias applied to the secondary transfer roller 25, and temperatures for fixation by the heaters 21*ah* and 21*bh* of the fixing roller 21*a* and the pressure roller 21*b*, respectively. The present exemplary embodiment illustrates a plurality of heaters, i.e., the heaters 21*ah* and 21*bh*. Alternatively, the fixing device 21 may be configured using one heater.

The reason that the optical sensor 50 is disposed at the position illustrated in FIG. 1 will be described. First, providing the optical sensor 50 at each of the paper feed ports of the sheet feeding cassette 15 and the manual feed tray 32, leads to an increase in cost. Accordingly, in the present exemplary embodiment, the optical sensor 50 is disposed at a position on a downstream side of the position where the conveyance paths from the paper feed ports merge. With this configuration, the sheet P fed from the sheet feeding cassette 15 and the sheet P fed from the manual feed tray 32 can be detected by a single optical sensor 50. If the optical sensor 50 is disposed in a range from the position where the conveyance paths from the paper feed ports merge to the nip portion formed by the paper dust collecting roller 18*a* and the registration roller 18*b*, the conveyance flutter of the sheet P is increased, which results in deterioration in the detection accuracy of the optical sensor 50. Accordingly, in the present exemplary embodiment, the optical sensor 50 is disposed at the position illustrated in FIG. 1 such that the sheet P can be detected in a state where the sheet P is firmly nipped between the paper dust collecting roller 18*a* and the registration roller 18*b* and is stably conveyed.

Figure 2A:
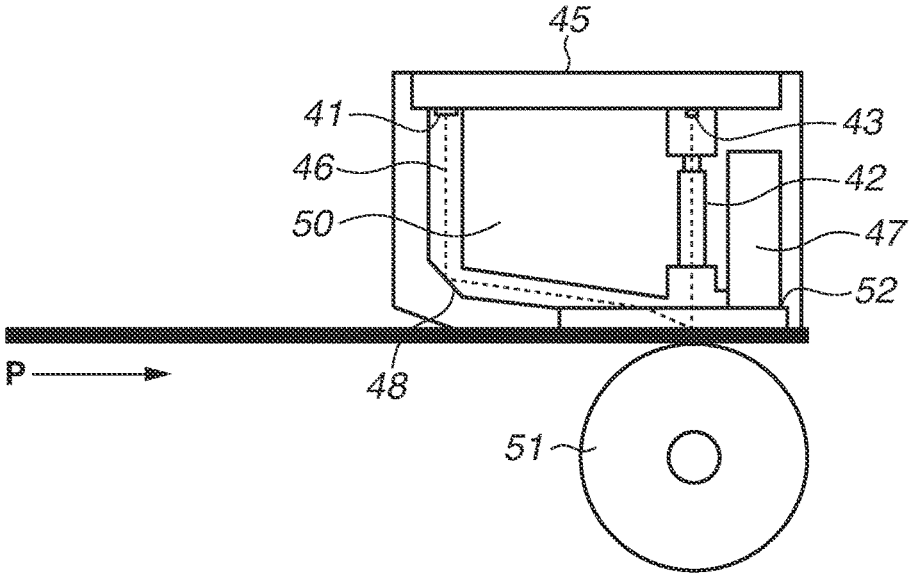
FIGS. 2A and 2B each illustrate a configuration of an optical sensor.
Figure 2B:
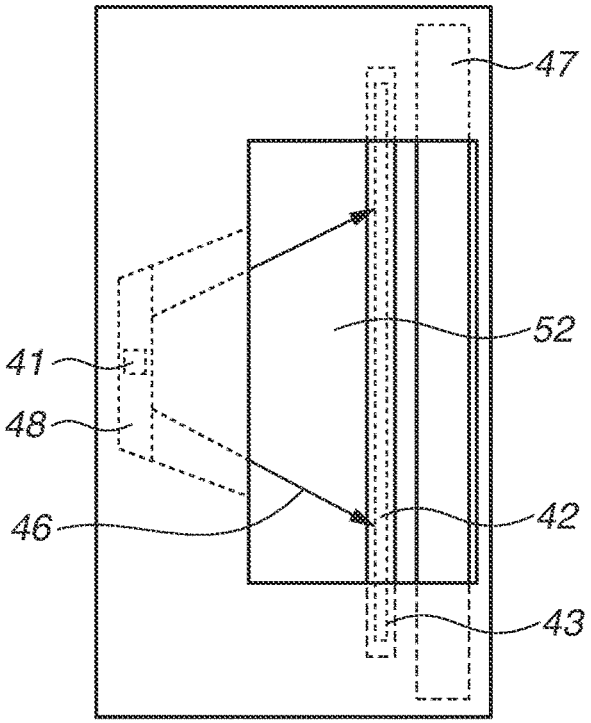

The configuration of the optical sensor 50 will be described with reference to FIGS. 2A and 2B. FIG. 2A is a sectional view of the optical sensor 50 as viewed along a direction (width direction of the sheet P) perpendicular to the conveyance direction of the sheet P. FIG. 2B is a top view of the optical sensor 50 as viewed along a direction vertical to the surface of the sheet P. In FIG. 2B, a lid for an upper portion is illustrated as a partially perspective view for ease of understanding of the position of a light source and the like.

Referring first to FIG. 2A, the optical sensor 50 irradiates the inside of a cover member 52 with light along an optical path 46 via a return reflection unit 48 by using a chip light-emitting diode (LED) 41 (irradiation unit), which is placed on a substrate 45, as a light source. The cover member 52 is a transparent member (clear acrylic, glass, or the like as a material) that comes into contact with the sheet P to guide the sheet P and prevents dust from entering into the optical sensor 50. The light irradiated from the inside of the cover member 52 passes through the cover member 52 and is irradiated on the sheet P at a small angle of about 10 degrees to 15 degrees with respect to the surface of the sheet P.

Light irregularly reflected on the surface of the sheet P is condensed by a light condensing element (rod lens array) 42 and is captured as an image of the surface of the sheet P by an image sensor (complementary metal-oxide semiconductor (CMOS) line sensor) 43 placed on the substrate 45. Light regularly reflected on the surface of the cover member 52 and the surface of the sheet P enters a light trap unit 47 and is self-attenuated in the light trap unit 47. This prevents stray light to the image sensor 43. In addition, the driven roller 51 improves the conveying property of the sheet P and suppresses the conveyance flutter of the sheet P. The driven roller 51 and the cover member 52 form a nip portion and are driven and rotated by the sheet P, while the sheet P is nipped by the nip portion. In this manner, the cover member 52 also functions as a guide member that comes into contact with the sheet P to guide the sheet P.

The units described throughout the present disclosure are exemplary and/or preferable modules for implementing processes described in the present disclosure. The term "unit", as used herein, may generally refer to firmware, software, hardware, or another component, such as circuitry or the like, or any combination thereof, that is used to effectuate a purpose. The modules can be hardware units (such as circuitry, firmware, a field programmable gate array, a digital signal processor, an application specific integrated circuit, or the like) and/or software modules (such as a computer readable program or the like). The modules for implementing the various steps are not described exhaustively above. However, where there is a step of performing a certain process, there may be a corresponding functional module or unit (implemented by hardware and/or software) for implementing the same process. Technical solutions by all combinations of steps described and units corresponding to these steps are included in the present disclosure.

Figure 3:
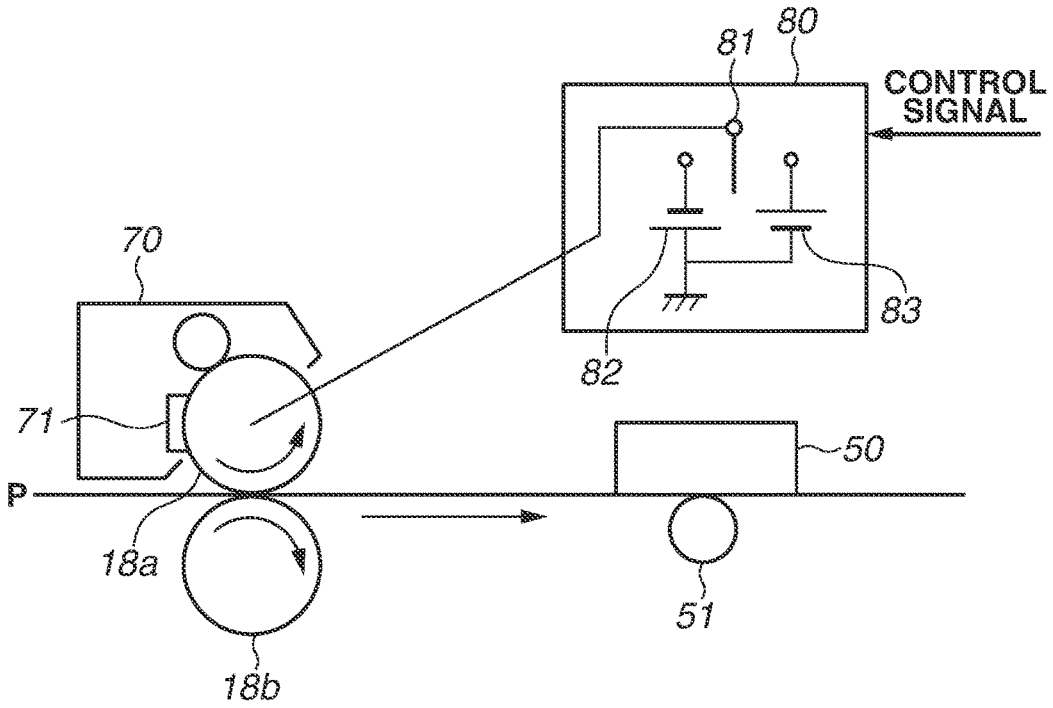
FIG. 3 illustrates a layout and schematic configuration of a paper dust collecting roller according to a first exemplary embodiment.

A configuration of each bias circuit for applying a high-voltage bias to the paper dust collecting roller 18*a* will be described with reference to FIG. 3. When a high-voltage bias of a predetermined polarity is applied to the paper dust collecting roller 18*a*, the paper dust collecting roller 18*a* can collect paper dust having a polarity opposite to the predetermined polarity from the sheet P that is in contact with the paper dust collecting roller 18*a*. A paper dust collecting portion 70 and a paper dust scraping-off unit 71 are placed on an outer peripheral portion of the paper dust collecting roller 18*a*. The paper dust collected by the paper dust collecting roller 18*a* is scraped off by the paper dust scraping-off unit 71 and accumulated in the paper dust collecting portion 70. The high-voltage bias generating unit 80 is connected to the paper dust collecting roller 18*a*, and the high-voltage bias generated by the high-voltage bias generating unit 80 is applied to the paper dust collecting roller 18*a*. The high-voltage bias generating unit 80 can generate the high-voltage bias from two high-voltage bias circuits 82 and 83 (output circuits) having different polarities, i.e., negative and positive polarities, respectively. The high-voltage bias switching unit 81 can switch the polarity of the high-voltage bias to be output. The high-voltage bias switching unit 81 and the high-voltage bias circuits 82 and 83 are controlled by a control signal sent from the control unit 10.

Figure 4:
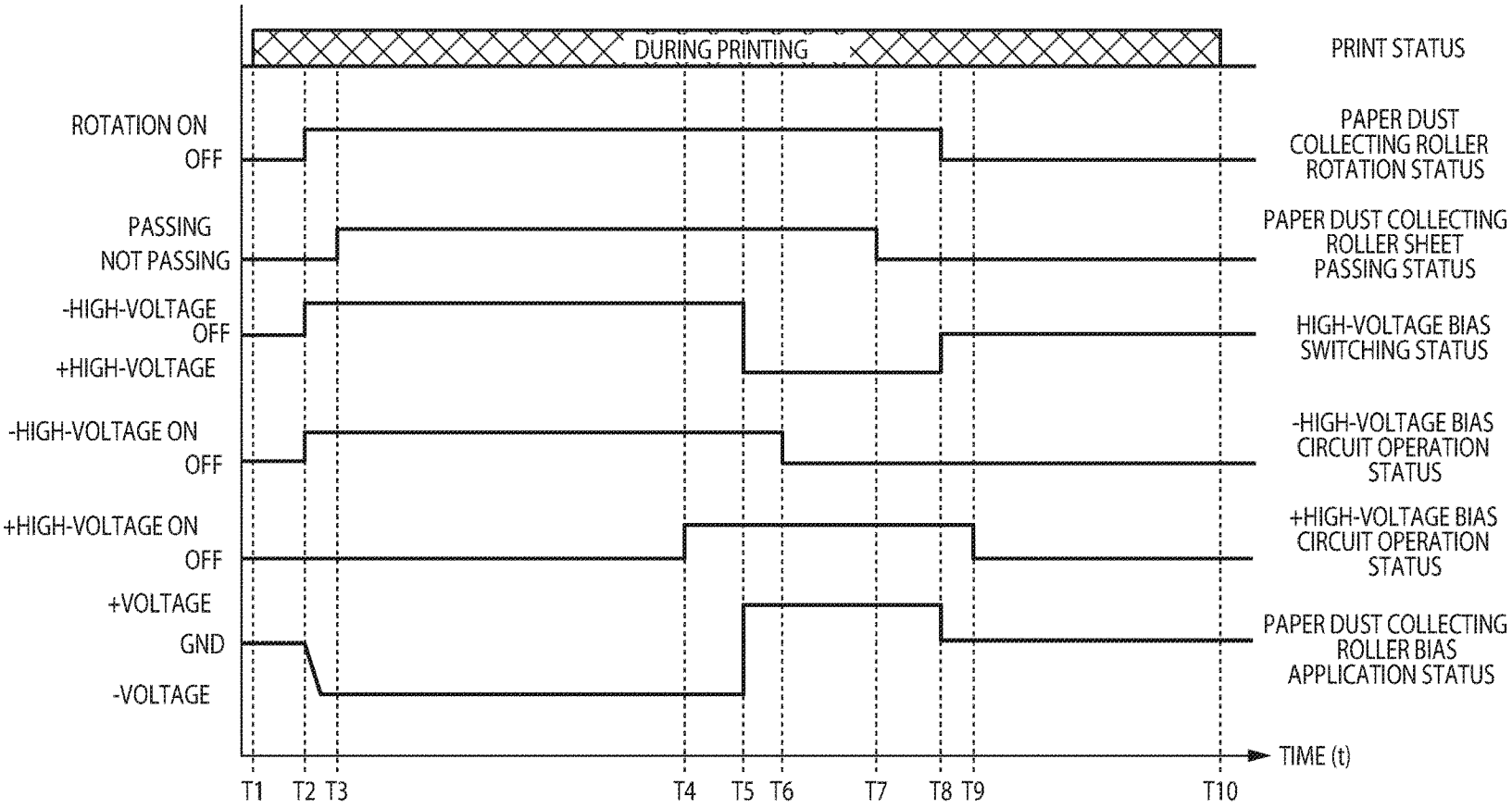
FIG. 4 is a graph illustrating operation timings of the paper dust collecting roller according to the first exemplary embodiment.

A timing for applying the high-voltage bias to the paper dust collecting roller 18*a* will be described with reference to FIG. 4. A graph in the first stage in FIG. 4 represents the print status of the printer 100 described above with reference to FIG. 1. A graph in the second stage in FIG. 4 illustrates the rotation status of the paper dust collecting roller 18*a*. A graph in the third stage in FIG. 4 illustrates whether the sheet P is passing along the paper dust collecting roller 18*a*. A graph in the fourth stage in FIG. 4 represents the switching status of the high-voltage bias switching unit 81. Graphs in the fifth and sixth stages in FIG. 4 respectively represent the operation statuses of the high-voltage bias circuits 82 and 83 at each polarity. A graph in the seventh stage in FIG. 4 represents the application status of the high-voltage bias to the paper dust collecting roller 18*a*.

The timings will now be described along with a time (t). First, the control unit 10 starts a print operation at timing T1. At the next timing T2, the control unit 10 starts driving the motor (not illustrated) to start the rotation of each of the paper dust collecting roller 18*a* and the registration roller 18*b*. At the same time, the control signal from the control unit 10 causes the high-voltage bias circuit 82 having a negative polarity to be turned on, so that the negative-polarity high-voltage bias rises. The control signal from the control unit 10 causes the high-voltage bias switching unit 81 to be switched to the negative-polarity high-voltage bias side from an OFF position.

Timing T3 represents a timing when the leading edge of the sheet P fed by the sheet feeding roller 19 has reached the nip portion formed by the paper dust collecting roller 18*a* and the registration roller 18*b*. At timing T4, the control signal from the control unit 10 causes the high-voltage bias circuit 83 having a positive polarity to be turned on, so that the positive-polarity high-voltage bias rises. After that, at timing T5 when the sheet P is passing through the space between the paper dust collecting roller 18*a* and the registration roller 18*b*, the control signal from the control unit 10 causes the high-voltage bias switching unit 81 to be switched to the positive-polarity high-voltage bias side. At the next timing T6, the control unit 10 turns off the high-voltage bias circuit 82 having a negative polarity, to thereby stop outputting the negative-polarity bias.

After that, timing T7 represents a timing when a trailing edge of the sheet P has passed through the space between the paper dust collecting roller 18*a* and the registration roller 18*b*. At timing T8, the control signal from the control unit 10 causes driving of the motor (not illustrated) to be stopped, to thereby stop the rotation of each of the paper dust collecting roller 18*a* and the registration roller 18*b*. Further, the control signal from the control unit 10 causes the high-voltage bias switching unit 81 to be switched to the OFF position. At the next timing T9, the control unit 10 turns off the high-voltage bias circuit 83 having a positive polarity, to thereby stop outputting the positive-polarity bias. Then, an image is formed on the sheet P. Timing T10 indicates that the print operation is terminated.

As described above, in the present exemplary embodiment, the negative-polarity high-voltage bias is applied to the paper dust collecting roller 18*a* from timing T2, and the positive-polarity high-voltage bias is applied to the paper dust collecting roller 18*a* from timing T5. The sheet P passes along the paper dust collecting roller 18*a* during the period from timing T3 to timing T7. Accordingly, the control unit 10 switches the polarity of the high-voltage bias during the time interval when one sheet P is passing along the paper dust collecting roller 18*a*.

In this case, at timing T5 when the polarity of the high-voltage bias to be applied to the paper dust collecting roller 18*a* is switched, the paper dust collection ability of the paper dust collecting roller 18*a* is temporarily lowered. Therefore, timing T5 when the polarity of the high-voltage bias is switched may be set after the timing when the position where the sheet feeding roller 19 has come in contact with the sheet P has passed through the space between the paper dust collecting roller 18*a* and the registration roller 18*b*. This is because, as described above, on the surface of the sheet P, the position where paper dust is particularly likely to be attached corresponds to the position where the sheet feeding roller 19 comes into contact with the sheet P.

In the present exemplary embodiment, the control signal from the control unit 10 performs ON/OFF control of the high-voltage bias circuits 82 and 83 having negative and positive polarities, respectively, at different timings. Alternatively, ON/OFF control of the high-voltage bias circuits 82 and 83 may be performed at the same timing. In the present exemplary embodiment, the high-voltage bias switching unit 81 can switch the polarity of the bias among three polarity positions including the OFF position. Alternatively, the high-voltage bias switching unit 81 may switch the polarity of the bias between two polarities, i.e., the positive polarity and the negative polarity, without setting the OFF position. In addition, if a circuit configuration in which a positive-polarity high-voltage bias and a negative-polarity high-voltage bias can be superimposed is used, the circuit configuration can function as the high-voltage bias switching unit 81.

Next, the charging status of the cover member 52 of the optical sensor 50 will be described with reference to FIG. 5. A graph in the first stage in FIG. 5 indicates whether the sheet P is passing along the paper dust collecting roller 18*a*. A graph in the second stage in FIG. 5 indicates whether the sheet P is passing along the optical sensor 50. A graph in the third stage in FIG. 5 indicates whether the optical sensor 50 detects the sheet P. A graph in the fourth stage in FIG. 5 represents the charging status of the cover member 52.

The timings will now be described along with a time (t'). First, timing T1' is a timing when the leading edge of the sheet P has reached the paper dust collecting roller 18*a*. The next timing T2' is a timing when the leading edge of the sheet P has reached the detection range of the optical sensor 50. In other words, timing T2' is a timing when the leading edge of the sheet P comes into contact with the cover member 52. After that, during a period from timing T3' to timing T4', the optical sensor 50 detects the sheet P which is being conveyed, or captures an image of the surface of the sheet P.

Timing T5' is a timing when the trailing edge of the sheet P has passed through the space between the paper dust collecting roller 18*a* and the registration roller 18*b*. Timing T6' is a timing when portions of the sheet P that have different charge polarities have reached the detection range of the optical sensor 50. In other words, timing T6' is a timing when the portions of the sheet P that have different charge polarities come into contact with the cover member 52. Timing T7' is a timing when the trailing edge of the sheet P has passed through the detection range of the optical sensor 50. If timings T5' and T6' may be reversed depending on the distance between the paper dust collecting roller 18*a* and the optical sensor 50.

Figure 5:
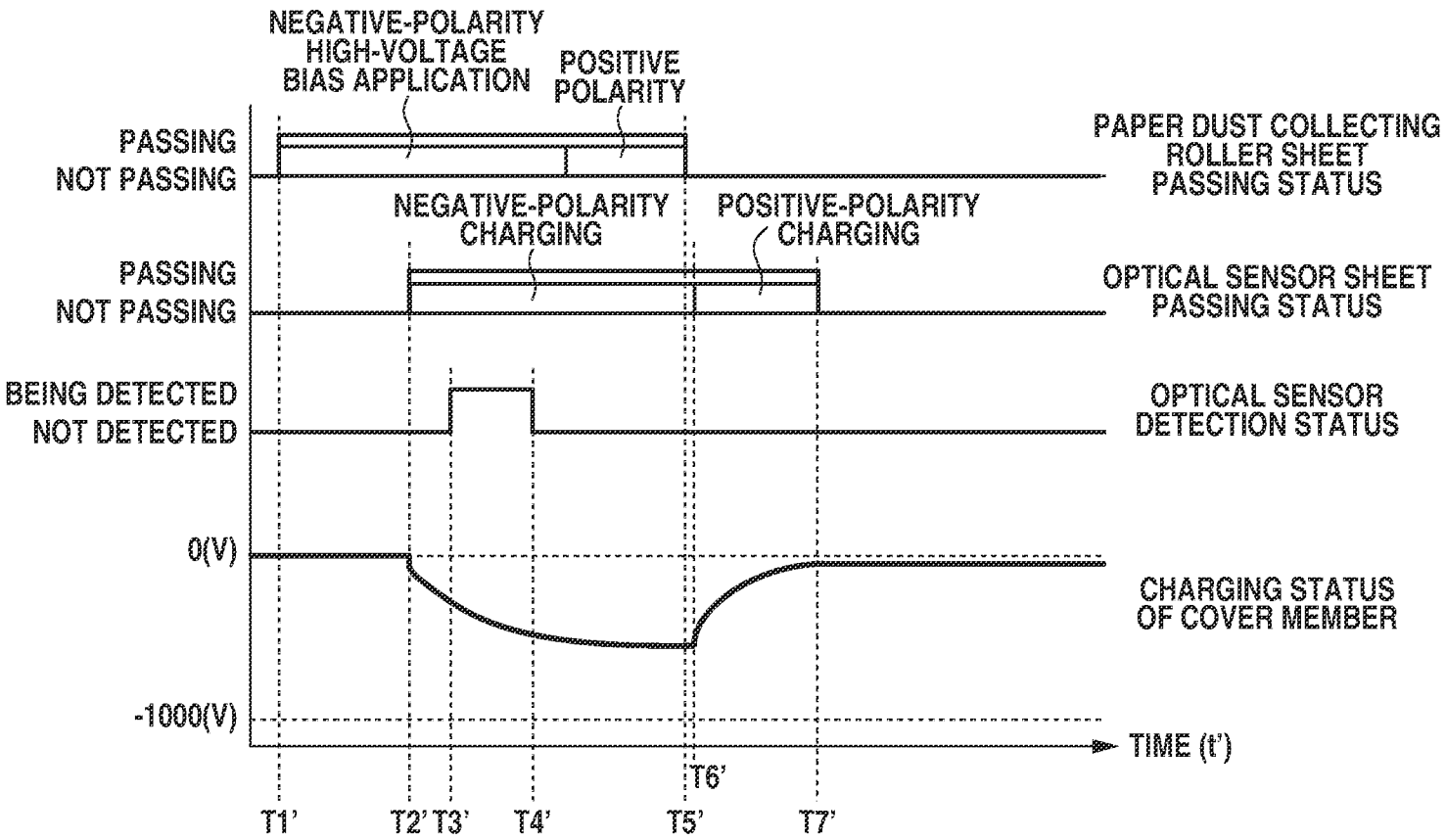
FIG. 5 is a graph illustrating operation timings of an optical sensor according to the first exemplary embodiment.

As illustrated in FIG. 5, when the sheet P charged by the paper dust collecting roller 18*a* passes along the optical sensor 50, the cover member 52 and the sheet P are brought into contact with each other and rubbed together, so that the cover member 52 is charged. However, the polarity of the bias to be applied to the paper dust collecting roller 18*a* is controlled to provide the surface of the sheet P with a charge distribution at both polarities, thereby enabling the sheet P, which is being conveyed, to eliminate the charge or reduce the charge intensity on the cover member 52. Consequently, it is possible to prevent dust or the like suspended in the printer 100 from being adsorbed to the cover member 52 and suppress a deterioration in the detection accuracy of the optical sensor 50.

As described above, according to the present exemplary embodiment, it is possible to suppress a deterioration in the detection accuracy of an optical detection unit in an image forming apparatus including an paper dust collecting unit and the optical detection unit.

The high-voltage bias generating unit 80 according to the first exemplary embodiment includes the two high-voltage bias circuits 82 and 83 having different polarities, and the high-voltage bias to be output from the two circuits is switched to thereby switch the polarity of the bias to be applied to the paper dust collecting roller 18*a*. In a second exemplary embodiment, a configuration will be described in which the polarity of the bias to be applied to the paper dust collecting roller 18*a* is switched using a charging member that comes into contact with the paper dust collecting roller 18*a* to triboelectrically charge the paper dust collecting roller 18*a*, and a single high-voltage bias circuit. Descriptions of main components of the second exemplary embodiment are similar to those of the first exemplary embodiment, and thus only the components of the second exemplary embodiment that are different from those of the first exemplary embodiment will be described.

A configuration of a bias circuit for applying a high-voltage bias to the paper dust collecting roller 18*a* according to the present exemplary embodiment will be described with reference to FIG. 6. A paper dust collecting portion 90 and a self-charging unit 91 are placed on an outer peripheral portion of the paper dust collecting roller 18*a*. Paper dust collected by the paper dust collecting roller 18*a* is scraped off by the self-charging unit 91 and accumulated in the paper dust collecting portion 90. Unlike the paper dust scraping-off unit 71 according to the first exemplary embodiment, the self-charging unit 91 comes into contact with the paper dust collecting roller 18*a* while scraping off the paper dust, and triboelectrically charges the paper dust collecting roller 18*a* to a negative polarity. To triboelectrically charge the paper dust collecting roller 18*a* to the negative polarity, polyester is used as a material for the self-charging unit 91 in the present exemplary embodiment. Any other material may be used as long as the material has a property similar to that of polyester.

In addition, a conductive brush 92 is placed on an outer peripheral portion of the paper dust collecting roller 18*a* on a downstream side of the self-charging unit 91. The conductive brush 92 is used to recharge the surface of the paper dust collecting roller 18*a* to a positive polarity at any timing, and is connected such that the high-voltage bias generated from a high-voltage bias generating unit 93 can be applied to the paper dust collecting roller 18*a*. The high-voltage bias generating unit 93 can generate the high-voltage bias from a positive-polarity high-voltage bias circuit 94. A high-voltage bias switching unit 95 switches the high-voltage bias circuit 94 to be connected to the paper dust collecting roller 18*a* or disconnected from the paper dust collecting roller 18*a*. The high-voltage bias switching unit 95 and the high-voltage bias circuit 94 are controlled by a control signal sent from the control unit 10.

In the present exemplary embodiment, when the positive-polarity bias is not applied, the high-voltage bias circuit 94 is configured to be capable of switching between insulation and conduction so as not to inhibit charging of the surface of the paper dust collecting roller 18*a*. However, if a mechanism capable of applying a sufficient positive-polarity high-voltage bias through a high resistance or the like is used, the high-voltage bias switching unit 95 may be omitted.

Figure 7:
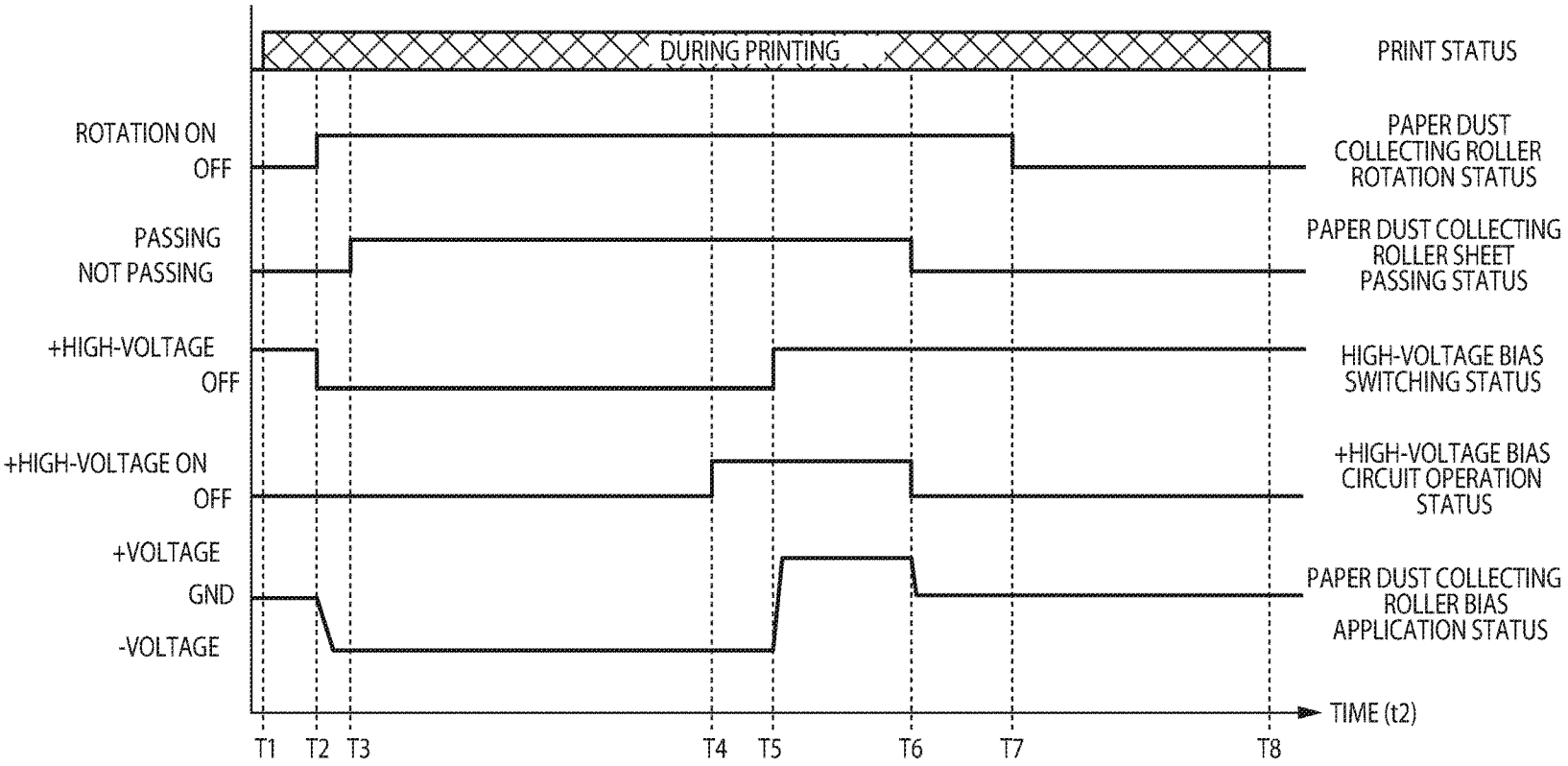
FIG. 7 is a graph illustrating operation timings of the paper dust collecting roller according to the second exemplary embodiment.

A timing for applying the high-voltage bias to the paper dust collecting roller 18*a* according to the present exemplary embodiment will be described with reference to FIG. 7. A graph in the first stage in FIG. 7 represents the print status of the printer 100 described above with reference to FIG. 1. A graph in the second stage in FIG. 7 represents the rotation status of the paper dust collecting roller 18*a*. A graph in the third stage in FIG. 7 indicates whether the sheet P is passing through the paper dust collecting roller 18*a*. A graph in the fourth stage in FIG. 7 represents the switching status of the high-voltage bias switching unit 95. A graph in the fifth stage in FIG. 7 represents the operation status of the positive-polarity high-voltage bias circuit 94. A graph in the sixth stage in FIG. 7 represents the application status of the high-voltage bias to the paper dust collecting roller 18*a*.

The timings will now be described along with a time (t2). First, the control unit 10 starts a print operation at timing T1. At the next timing T2, the control unit 10 starts driving the motor (not illustrated) to start the rotation of each of the paper dust collecting roller 18*a* and the registration roller 18*b*. At the same time, the control signal from the control unit 10 causes the high-voltage bias switching unit 95 to be switched to the OFF position, so that the negative-polarity self-bias rises.

Timing T3 represents a timing when the leading edge of the sheet P fed by the sheet feeding roller 19 has reached the nip portion formed by the paper dust collecting roller 18*a* and the registration roller 18*b*. At timing T4, the control signal from the control unit 10 causes the high-voltage bias circuit 94 having a positive polarity to be turned on, so that the positive-polarity high-voltage bias rises. After that, at timing T5 when the sheet P is passing through the space between the paper dust collecting roller 18*a* and the registration roller 18*b*, the control signal from the control unit 10 causes the high-voltage bias switching unit 95 to be switched to the positive-polarity high-voltage bias side.

Timing T6 represents a timing when the trailing edge of the sheet P has passed through the space between the paper dust collecting roller 18*a* and the registration roller 18*b*. At the same timing, the control unit 10 turns off the positive-polarity high-voltage bias circuit 94, to thereby stop outputting the positive-polarity bias. After that, at timing T7, the control signal from the control unit 10 causes driving of the motor (not illustrated) to be stopped, to thereby stop the rotation of each of the paper dust collecting roller 18*a* and the registration roller 18*b*. Then, an image is formed on the sheet P. Timing T8 indicates that the print operation is terminated.

As described above, in the present exemplary embodiment, the negative-polarity high-voltage bias is applied to the paper dust collecting roller 18*a* from timing T2, and the positive-polarity high-voltage bias is applied to the paper dust collecting roller 18*a* from timing T5. The sheet P passes along the paper dust collecting roller 18*a* during the period from timing T3 to timing T6. Accordingly, the control unit 10 switches the polarity of the high-voltage bias during the period in which one sheet P is passing along the paper dust collecting roller 18*a*.

Like in the first exemplary embodiment, when the sheet P charged by the paper dust collecting roller 18*a* passes along the optical sensor 50, the cover member 52 and the sheet P are brought into contact with each other and rubbed together, so that the cover member 52 is charged. However, the polarity of the bias to be applied to the paper dust collecting roller 18*a* is controlled to provide the surface of the sheet P with a charge distribution at both polarities, thereby enabling the sheet P, which is being conveyed, to eliminate the charge or reduce the charge intensity on the cover member 52. Consequently, it is possible to prevent dust or the like suspended in the printer 100 from being adsorbed to the cover member 52 and suppress a deterioration in the detection accuracy of the optical sensor 50.

As described above, according to the present exemplary embodiment, an advantageous effect that the circuit configuration for applying the high-voltage bias can be simplified is obtained in addition to the advantageous effects of the first exemplary embodiment.

While the first and second exemplary embodiments illustrate a control operation for switching the polarity of the bias for one sheet P, a third exemplary embodiment illustrates a control operation for switching the polarity of the bias for two or more sheets P. Descriptions of main components of the third exemplary embodiment are similar to those of the second exemplary embodiment, and thus only the components of the third exemplary embodiment that are different from those of the second exemplary embodiment will be described.

Figure 8:
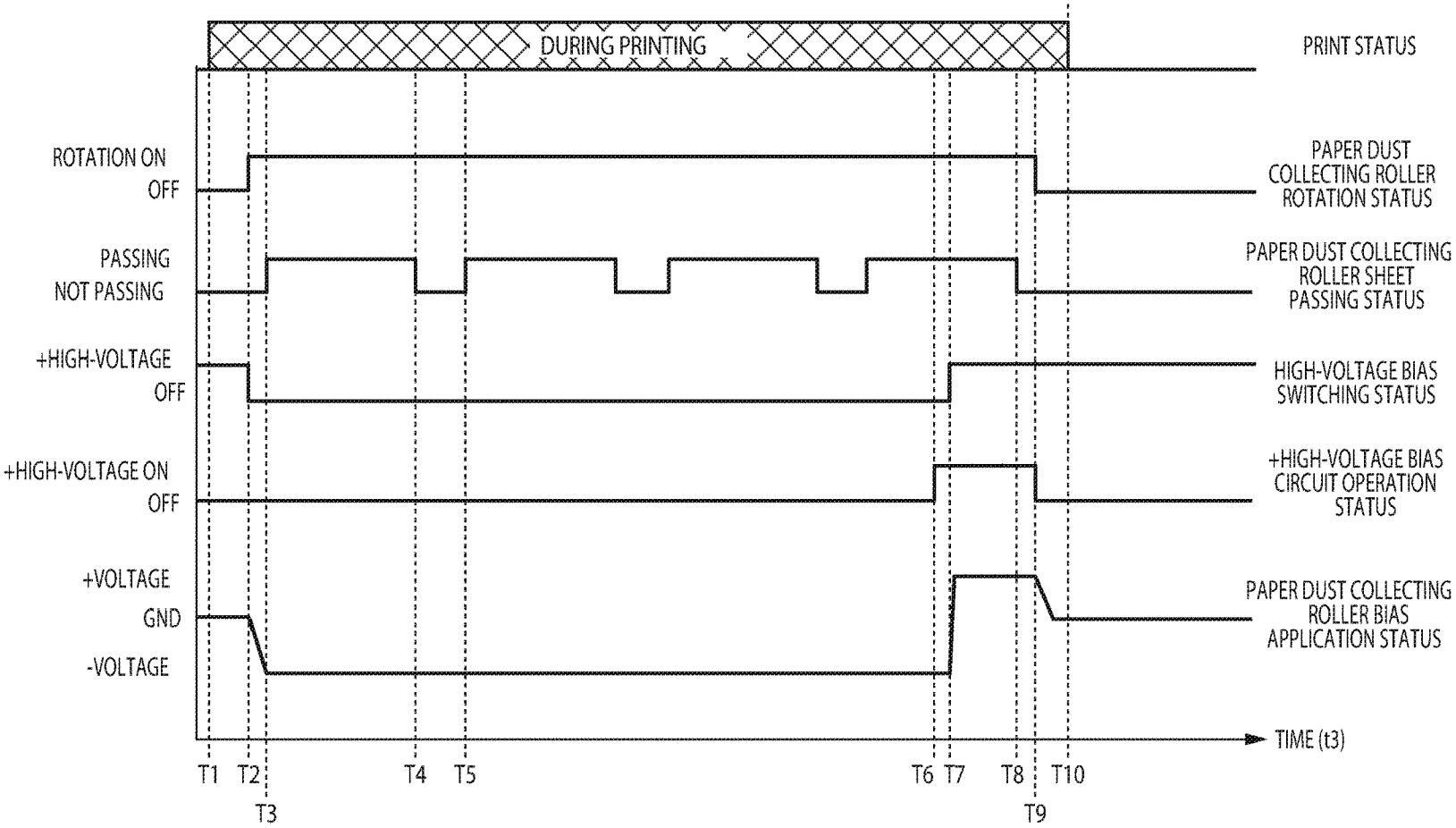
FIG. 8 is a graph illustrating operation timings of a paper dust collecting roller according to a third exemplary embodiment.

A timing for applying the high-voltage bias to the paper dust collecting roller 18*a* according to the present exemplary embodiment will be described with reference to FIG. 8. A graph in the first stage in FIG. 8 represents the print status of the printer 100 described above with reference to FIG. 1. A graph in the second stage in FIG. 8 represents the rotation status of the paper dust collecting roller 18*a*. A graph in the third stage in FIG. 8 indicates whether the sheet P is passing along the paper dust collecting roller 18*a*. A graph in the fourth stage in FIG. 8 represents the switching status of the high-voltage bias switching unit 95. A graph in the fifth stage in FIG. 8 represents the operation status of the positive-polarity high-voltage bias circuit 94. A graph in the sixth stage in FIG. 8 represents the application status of the high-voltage bias to the paper dust collecting roller 18*a*. FIG. 8 illustrates a case where continuous printing on four sheets is carried out.

The timings will now be described along with a time (t3). First, the control unit 10 starts a print operation at timing T1. At the next timing T2, the control unit 10 starts driving the motor (not illustrated) to start the rotation of each of the paper dust collecting roller 18*a* and the registration roller 18*b*. At the same time, the control signal from the control unit 10 causes the high-voltage bias switching unit 95 to be switched to the OFF position, so that the negative-polarity self-bias rises.

Timing T3 represents a timing when the leading edge of the first sheet P fed by the sheet feeding roller 19 has reached the nip portion formed by the paper dust collecting roller 18*a* and the registration roller 18*b*. The next timing T4 represents a timing when the trailing edge of the first sheet P has passed through the nip portion formed by the paper dust collecting roller 18*a* and the registration roller 18*b*. Timing T5 represents a timing when the leading edge of the second sheet P fed by the sheet feeding roller 19 has reached the nip portion formed by the paper dust collecting roller 18*a* and the registration roller 18*b*.

Continuous printing is carried out similarly, and during period in which the fourth sheet P, which is the last sheet P, is being conveyed, at timing T6, the control signal from the control unit 10 causes the high-voltage bias circuit 94 having a positive polarity to be turned on, so that the positive-polarity high-voltage bias rises. After that, at timing T7 when the fourth sheet P is passing through the space between the paper dust collecting roller 18*a* and the registration roller 18*b*, the control signal from the control unit 10 causes the high-voltage bias switching unit 95 to be switched to the positive-polarity high-voltage bias side.

Timing T8 represents a timing when the trailing edge of the fourth sheet P has passed through the space between the paper dust collecting roller 18*a* and the registration roller 18*b*. At timing T9, the control unit 10 turns off the high-voltage bias circuit 94 having the positive polarity, to thereby stop outputting the positive-polarity bias. At the same time, the control signal from the control unit 10 causes driving of the motor (not illustrated) to be stopped, to thereby stop the rotation of each of the paper dust collecting roller 18*a* and the registration roller 18*b*. Then, an image is formed on the fourth sheet P. Timing T10 indicates that the print operation is terminated.

As described above, in the present exemplary embodiment, the negative-polarity high-voltage bias is applied to the paper dust collecting roller 18*a* from timing T2, and the positive-polarity high-voltage bias is applied to the paper dust collecting roller 18*a* from timing T7. The control unit 10 does not switch the polarity of the high-voltage bias in a time interval when the first to third sheets P pass along the paper dust collecting roller 18*a*, and switches the polarity of the high-voltage bias in a time interval when the fourth sheet P passes along the paper dust collecting roller 18*a*.

Specifically, when the first to third sheets P charged by the paper dust collecting roller 18*a* pass along the optical sensor 50, the cover member 52 and the first to third sheets P are brought into contact with each other and rubbed together, so that the cover member 52 is charged. However, the polarity of the bias to be applied to the paper dust collecting roller 18*a* is controlled to provide the surface of the fourth sheet P with a charge distribution at both polarities, thereby enabling the fourth sheet P, which is being conveyed, to eliminate the charge or reduce the charge intensity on the cover member 52. Consequently, it is possible to prevent dust or the like suspended in the printer 100 from being adsorbed to the cover member 52 and suppress a deterioration in the detection accuracy of the optical sensor 50.

As described above, according to the present exemplary embodiment, the number of times of switching the high-voltage bias can be reduced as compared with the second exemplary embodiment. Therefore, an advantageous effect that the switching control operation can be simplified is obtained.

The present exemplary embodiment illustrates the operation for switching the polarity of the high-voltage bias in a time interval when the fourth sheet P is passing along the paper dust collecting roller 18*a*. However, the present disclosure is not limited to this. For example, the polarity of the high-voltage bias may be switched immediately before the leading edge of the fourth sheet P reaches the paper dust collecting roller 18*a*. In this case, the entirety of the fourth sheet P is charged to a positive polarity.

The present exemplary embodiment illustrates the control operation for switching the polarity of the bias for the last sheet P during continuous printing. However, the polarity of the bias may be switched for a sheet other than the last sheet P. For example, the polarity of the high-voltage bias may be switched in a time interval when the third sheet P is passing along the paper dust collecting roller 18*a*.

Figure 6:
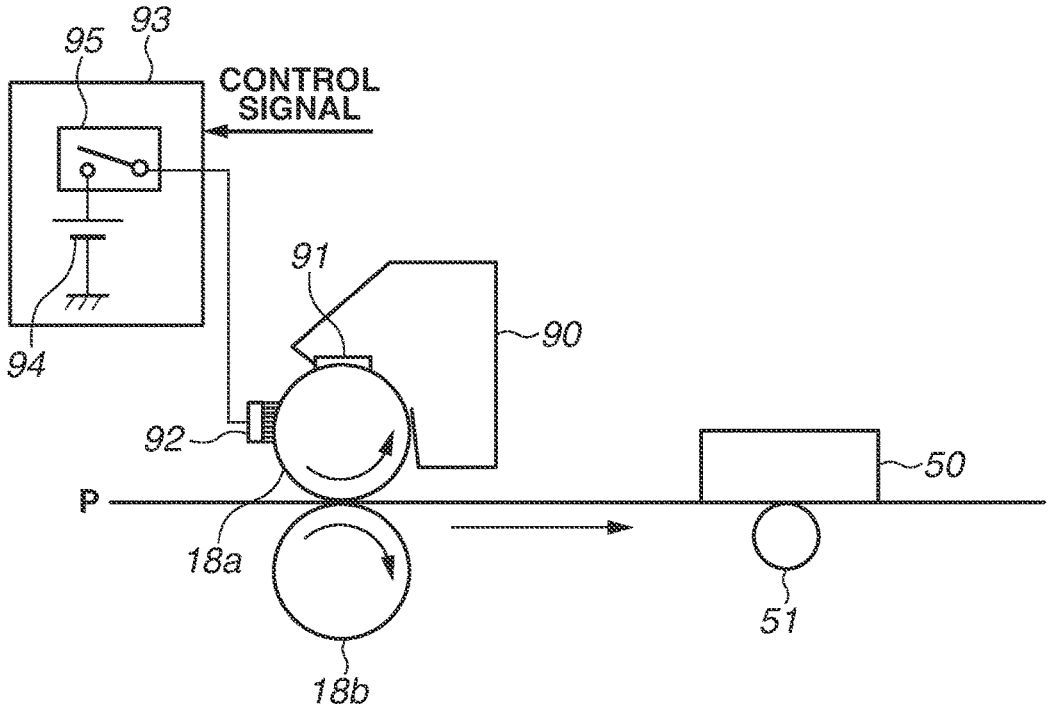
FIG. 6 illustrates a layout and schematic configuration of a paper dust collecting roller according to a second exemplary embodiment.

In the present exemplary embodiment, the configuration of the bias circuit according to the second exemplary embodiment illustrated in FIG. 6 has been described by way of example. However, a control operation similar to that described above may be carried out in the configuration of each bias circuit according to the first exemplary embodiment illustrated in FIG. 3.

In the first to third exemplary embodiments, the state where the paper dust collecting roller 18*a* is charged to a negative polarity is switched to the state where the paper dust collecting roller 18*a* is charged to a positive polarity. However, the order of switching the states may be reversed. When the negative-polarity high-voltage bias is applied to the paper dust collecting roller 18*a*, paper dust having a positive polarity is collected, and when the positive-polarity high-voltage bias is applied to the paper dust collecting roller 18*a*, paper dust having a negative polarity is collected. This is because there is no difference between paper dust collection abilities for different polarities.

The first to third exemplary embodiments illustrate the control operation for switching the polarity of the bias in a time interval when the sheet P on which an image is to be formed is being conveyed. However, the present disclosure is not limited to this. For example, the control operation for switching the polarity of the bias by feeding the sheet P on which no image is to be formed, after the image formation is finished, may be carried out. In other words, the cover member 52 may be neutralized by the sheet P on which no image is formed. At this time, the sheet P on which no image is to be formed may be discharged as a blank sheet, without forming an image on the sheet P, or may be discharged in a state where a message indicating that the sheet P is not an image forming target is printed on the sheet P.

The first to third exemplary embodiments illustrate an example where the optical sensor 50 captures an image of the surface of the sheet P. However, the present disclosure is not limited to this example. A sensor that receives reflected light from the sheet P to detect the surface state of the sheet P may be used. Alternatively, a sensor that captures transmitted light from the sheet P as an image, or receives transmitted light from the sheet P, to detect the thickness of the sheet P may be used.

When the optical sensor 50 is a transmitted light detection type, it is assumed that at least one of light directed toward the sheet P from the irradiation unit such as the chip LED 41 and light directed toward an image pickup unit, such as the image sensor 43, and a light receiving unit from the sheet P passes through the cover member 52.

In the first to third exemplary embodiments, the optical sensor 50 is a so-called media sensor used to discriminate the type of the sheet P. However, the optical sensor 50 is not limited to this sensor. For example, a ranging sensor that receives reflected light from the sheet P to detect the distance from the sensor to the sheet P, i.e., the loop amount of the sheet P, may be used as the optical sensor 50. The control unit 10 controls the conveyance speed (image forming conditions) of the sheet P based on the loop amount of the sheet P detected by the ranging sensor. This configuration prevents the rollers from forming an excessive loop on the sheet P.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2017-078737, filed Apr. 12, 2017, which is hereby incorporated by reference herein in its entirety.

What is claimed is:

1. An image forming apparatus comprising:

a paper dust collecting unit configured to collect, by application of a voltage, paper dust attached to a sheet;

an optical detection unit provided on a downstream side of the paper dust collecting unit in a sheet conveyance direction, the optical detection unit being configured to irradiate the sheet with light and receive light via the sheet;

a guide member configured to come into contact with the sheet for guiding the sheet, at least one of light directed toward the sheet from the optical detection unit and light directed toward the optical detection unit from the sheet passing through the guide member; and a control unit configured to switch a polarity of the voltage to be applied to the paper dust collecting unit and cause the sheet charged through the paper dust collecting unit to be conveyed to the guide member.

2. The image forming apparatus according to claim 1, wherein the control unit switches the polarity of the voltage to be applied to the paper dust collecting unit in a time interval when one sheet on which an image is to be formed passes along the paper dust collecting unit.

3. The image forming apparatus according to claim 2, wherein in a case where an image is sequentially formed on two or more sheets, the control unit does not switch the polarity of the voltage to be applied to the paper dust collecting unit in a time interval when a first sheet passes along the paper dust collecting unit, and the control unit switches the polarity of the voltage to be applied to the paper dust collecting unit in a time interval when a second sheet to be conveyed after the first sheet passes along the paper dust collecting unit.

4. The image forming apparatus according to claim 3, wherein the second sheet is a sheet on which the image is formed last, among the two or more sheets on which the image is sequentially formed.

5. The image forming apparatus according to claim 1, wherein in a case where an image is sequentially formed on two or more sheets, the control unit does not switch the polarity of the voltage to be applied to the paper dust collecting unit in a time interval when a first sheet passes along the paper dust collecting unit, and the control unit switches the polarity of the voltage to be applied to the paper dust collecting unit before a leading edge of a second sheet to be conveyed after the first sheet reaches the paper dust collecting unit.

6. The image forming apparatus according to claim 1, wherein after formation of an image on the sheet is finished, the control unit causes a new sheet on which no image has been formed to be conveyed to the paper dust collecting unit, and in a time interval when the new sheet on which no image has been formed passes along the paper dust collecting unit, or before a leading edge of the new sheet on which no image has been formed reaches the paper dust collecting unit, the control unit switches the polarity of the voltage to be applied to the paper dust collecting unit.

7. The image forming apparatus according to claim 1, wherein the paper dust collecting unit comprises a paper dust collecting roller configured to come into contact with the sheet and rotate to collect the paper dust attached to the sheet and a paper dust collecting portion in which the paper dust collected by the paper dust collecting roller is accumulated.

8. The image forming apparatus according to claim 7, further comprising:

a first output circuit configured to output a positive-polarity bias;

a second output circuit configured to output a negative polarity bias; and a switching unit configured to connect one of the first output circuit and the second output circuit to the paper dust collecting roller, wherein the control unit controls the switching unit to switch the polarity of the voltage to be applied to the paper dust collecting roller.

9. The image forming apparatus according to claim 7, further comprising:

a charging member configured to come into contact with the paper dust collecting roller to be rotated to triboelectrically charge the paper dust collecting roller to a predetermined polarity;

an output circuit configured to output a bias of a polarity opposite to the predetermined polarity; and a switching unit configured to connect the output circuit to the paper dust collecting roller or disconnect the output circuit from the paper dust collecting roller, wherein the control unit controls the switching unit to switch the polarity of the voltage to be applied to the paper dust collecting roller.

10. The image forming apparatus according to claim 1, further comprising a rotary member forming a nip portion with the guide member, the rotary member being configured to rotate in a state where the sheet is nipped by the nip portion.

11. The image forming apparatus according to claim 1, wherein the guide member is formed of glass or clear acrylic.

12. The image forming apparatus according to claim 1, wherein the optical detection unit includes an irradiation unit configured to irradiate the sheet with light, and an image pickup unit configured to capture light reflected on the sheet as an image of a surface of the sheet.

13. The image forming apparatus according to claim 1, wherein the control unit changes at least one of a conveyance speed of the sheet, a transfer bias for transferring a toner image onto the sheet, and a fixation temperature for fixing, onto the sheet, the toner image transferred onto the sheet, based on a result of detection by the optical detection unit.

* * * * *